United States Patent [19]

Thompson

[11] 4,271,817

[45] Jun. 9, 1981

[54] FIRE ARRAY AND APPARATUS

[76] Inventor: E. Arthur Thompson, P.O. Box 456, Penllyn, Pa. 19422

[21] Appl. No.: 27,620

[22] Filed: Apr. 6, 1979

[51] Int. Cl.[3] ..... F23B 13/00

[52] U.S. Cl. ..... 126/298; 126/152 B; 211/60 R

[58] Field of Search ..... 126/152 R, 152 B, 164, 126/165, 298, 202, 201, 336, 114; 44/38, 40; 211/60 R

[56] References Cited

U.S. PATENT DOCUMENTS

| | | | |
|---|---|---|---|
| 2,985,165 | 5/1961 | Peterson et al. | 126/165 |
| 3,296,984 | 1/1967 | Durfee | 126/163 R |
| 3,307,532 | 3/1967 | Hume | 126/298 |
| 3,670,714 | 6/1972 | Eyges | 126/165 |
| 3,682,158 | 8/1972 | Thomas | 126/165 |
| 4,131,108 | 12/1978 | Bauder | 126/298 |

*Primary Examiner*—James C. Yeung

[57] ABSTRACT

An array for a log fire is described which promotes ignition and even burning of the logs. The array includes at least three logs, split or unsplit, which are maintained in a nested spaced apart relationship by an implement which creates a V-shaped locus between the facing log surfaces. One such implement is described as having a central rectilinear portion having affixed at each end thereof similar V-shaped portions upstanding therefrom, and oriented so as to form intersecting parallel planes. Another implement is described as having a central rectilinear portion, each end of which is bent to about a right angle therefrom and at a degree of displacement from the angle to which the other end is bent so that each end falls within one of two intersecting planes whose intersection lies along the rectilinear portion. Another implement is described as including at least a pair of similar V-shaped members which may be individually spaced apart within an array of logs so as to provide for improved ignition and even burning.

1 Claim, 6 Drawing Figures

FIRE ARRAY AND APPARATUS

BRIEF SUMMARY OF THE INVENTION

The burning of wood fires in private residences and elsewhere has heretofore mainly been for personal enjoyment and as supplementary heating. However, with increased environmental concern the economic use of wood fires has become a matter of general interest. Certain disadvantages of wood fires are well known. Among these are the difficulty in igniting the wood, the difficulty of maintaining the fire for long periods of time and the difficulty of achieving a flame pattern which will consume the wood fuel by the piece evenly throughout the length of the piece.

The apparatus of this invention tends to reduce these disadvantages to a minimum and produce an efficient, attractive and economic fire, as further described and shown in the drawings, wherein.

DETAILED DESCRIPTION OF THE DRAWINGS

Figure 1:
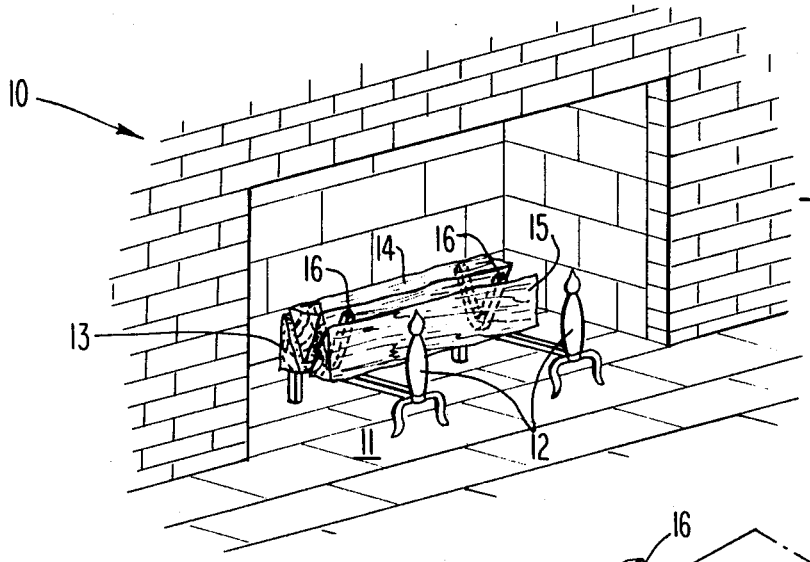
FIG. 1 is a perspective view of a fireplace set with a log fire array of this invention.
Figure 2:
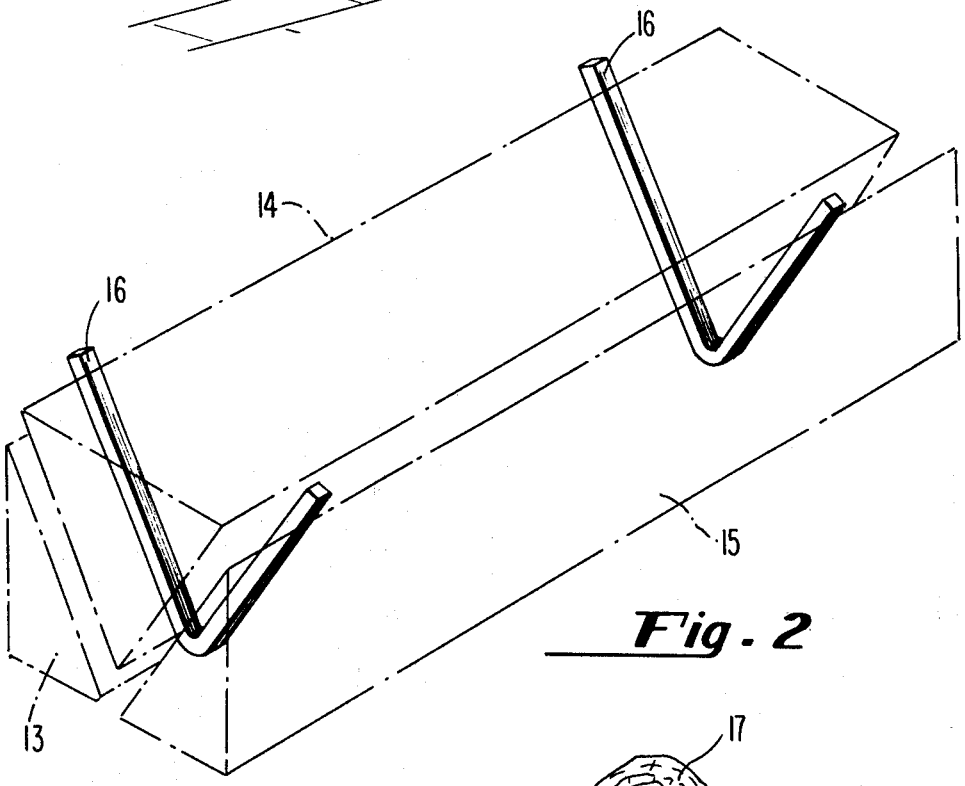
FIG. 2 is an enlarged view of a portion of FIG. 1, the logs being shown in phantom lines.
Figure 3:
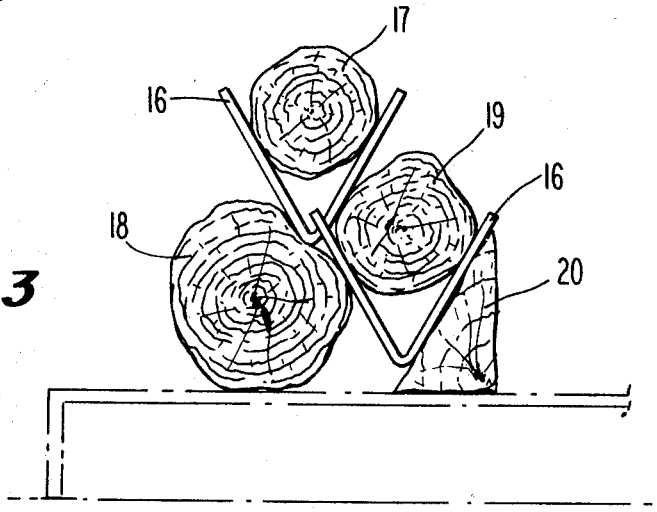
FIG. 3 is an end view of another log fire array in accordance with this invention, the andiron being shown in phantom lines.

Referring now to FIG. 1, a fireplace 10, consisting of a hearth 11 and andirons 12, is set with an array of three logs 13, 14, 15, in preparation for a fire. The logs, 13, 14, 15, are split logs having flat angular sides, which enables the logs to be nested as shown in FIG. 1, with the assistance of two implements 16. The implements 16 are generally V-shaped and are formed from heavy metal bar or rod stock, such as wrought iron or the like. When the array is formed as shown, logs 13 and 15 are first arranged on the andirons 12 and spaced apart by dropping the two implements 16 therebetween. As log 14 is placed into the space formed between log 13 and log 15, the implements 16 act to maintain a V-shaped locus between the facing log surfaces of logs 13, 14, 15, as shown in FIG. 2. This V-shaped locus creates a desirable draft space for the ignition and maintenance of a log fire. It is therefore only necessary to deposit light twigs, kindling or rolled paper under the nested logs and to ignite such material, in order to bring about a good log fire. Once begun, a fire is easily maintained when the array of this invention is utilized. Firstly, the V-shaped implements 16 act to maintain the desirable draft between logs 13, 14, 15 as the logs are consumed, by the force of gravity. If necessary or desired, further adjustments may readily be made by utilizing fire tongs to position the implements 16 while easily maintaining the desired log array. In FIG. 2, where logs 13, 14, 15 are shown in phantom lines, the function of implements 16 is clearly shown. Referring now to FIG. 3, it is seen that other desirable log fire arrays may be fashioned in accordance with the log array of this invention by using the novel implements of this invention. The additional arrays, for example, may include more than three logs, and also may be arranged with logs of varying shapes and sizes. For instance, in FIG. 3, the array shown comprises three round logs 17, 18, 19 and one split log 20. All of these logs are maintained in a desirable array by means of implements 16.

Figure 4:
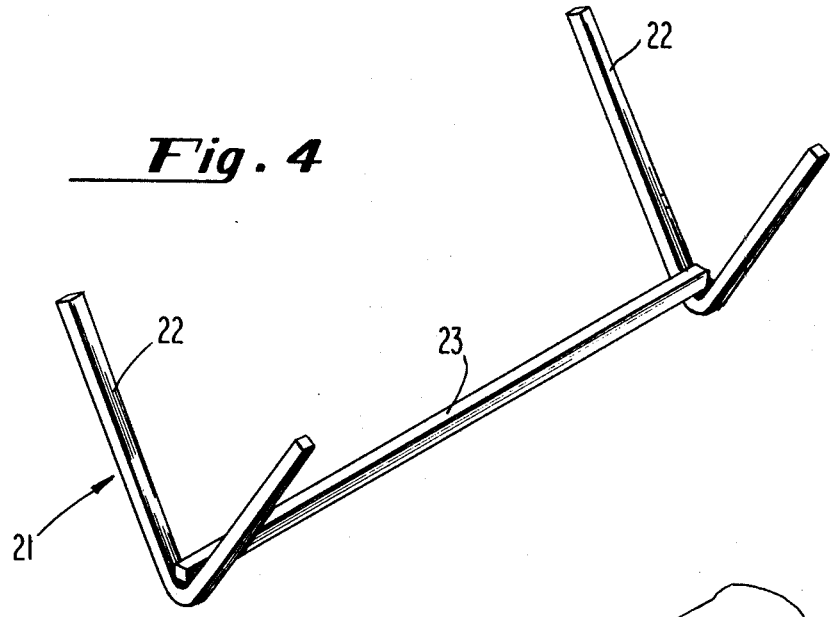
FIG. 4 is a perspective view of a fire implement in accordance with an embodiment of this invention.

Now referring to FIG. 4, another implement 21 for use in creating a log fire array is shown consisting of two juxtaposed V-shaped portions 22, which are rigidly connected by a straight bar 23. This implement has the advantage of always maintaining the alignment of portions 22 to more readily create the V-shaped draft space between logs.

Figure 5:
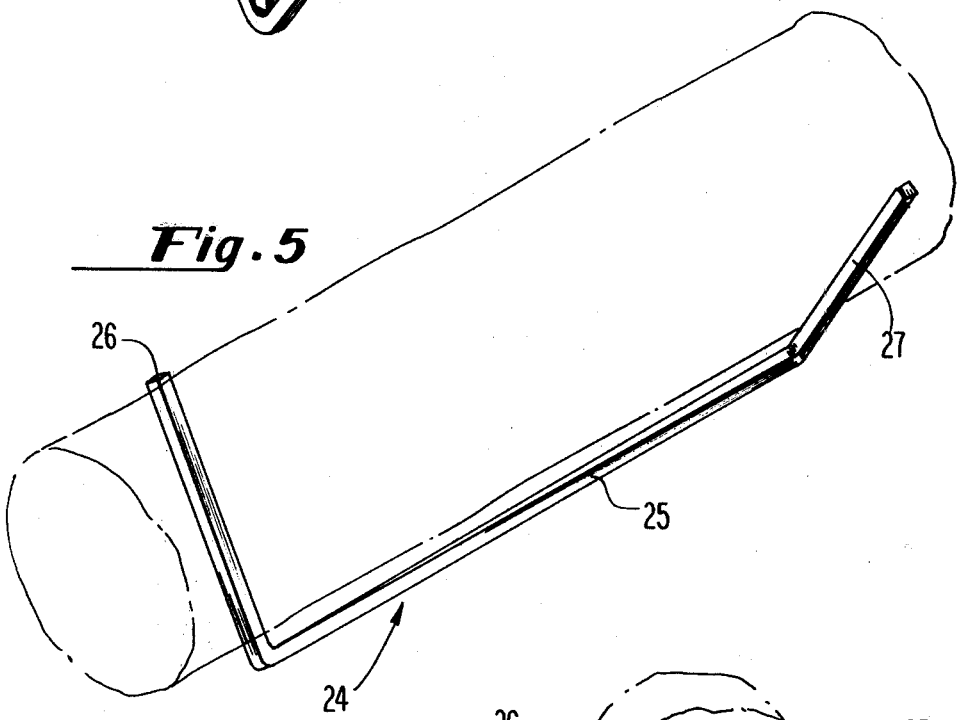
FIG. 5 is a perspective view of a fire implement in accordance with another embodiment of this invention, a log being shown in phantom lines.
Figure 6:
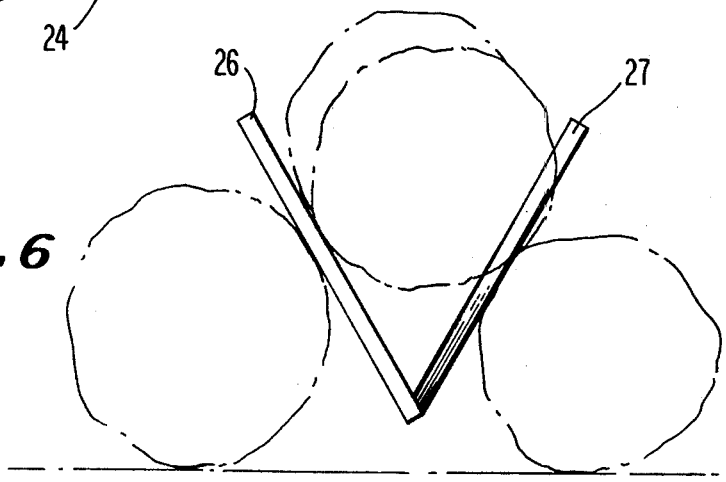
FIG. 6 is an end view of the implement shown in FIG. 5 in use to create an array in accordance with this invention.

Also, in FIG. 5, a still further implement 24 for use in the same manner as implement 21 is shown consisting of a rectilinear central portion 25 and bent end portions 26, 27 at opposite ends thereof. The angle chosen between the bent end portions 26, 27 more clearly shown in FIG. 6 is such as to form the V-shaped draft space necessary to form the log array of this invention. It is apparent that end portions 26, 27, while bent to about a right angle with respect to portion 25, are bent at different rotational angles about the axis of portion 25. It will readily be seen that implement 24, while performing the same function as implement 21, is simpler and of more economical construction.

The use of the log fire array and implements of this invention unexpectedly make it possible for customary fireplace logs to be ignited and maintain combustion throughout substantially their full length, with a resultant more efficient and more attractive fire.

Having thus described my invention, I claim:

1. An array for a log fire comprising andiron means adapted to support a plurality of logs in a generally horizontal position, a pair of logs supported on said andiron means in a parallel opposing relationship, implement means consisting of a fire resistant rigid structure adapted to provide a V-shaped supporting surface thereon, said implement means being supported by said pair of logs and acting to space said pair of logs apart, and a further log supported within the interior angle of the V-shaped supporting surface of the implement means, said array providing a generally V-shaped draft space between the three logs thereof.

* * * * *